US006196950B1

(12) United States Patent
Emick

(10) Patent No.: US 6,196,950 B1
(45) Date of Patent: Mar. 6, 2001

(54) EXERCISE DEVICE

(76) Inventor: Daniel W. Emick, Rear 514, Weldon St., Montoursville, PA (US) 17754

( * ) Notice: Subject to any disclaimer, the term of this patent is extended or adjusted under 35 U.S.C. 154(b) by 0 days.

(21) Appl. No.: 09/365,640

(22) Filed: Aug. 3, 1999

(51) Int. Cl.[7] ..... A63B 21/065
(52) U.S. Cl. ..... 482/105; 482/79; 482/139
(58) Field of Search ..... 482/79, 80, 93, 482/105, 145, 146, 147, 97, 100, 137–139

(56) References Cited

U.S. PATENT DOCUMENTS

| | | | | |
|---|---|---|---|---|
| 2,849,237 | * | 8/1958 | Simithis | 482/105 |
| 3,020,046 | * | 2/1962 | Hotas | 482/79 |
| 4,337,939 | * | 7/1982 | Hoyle et al. | 482/79 |
| 5,551,937 | * | 9/1996 | Kwo | 482/145 |
| 5,695,438 | * | 12/1997 | Bjornsti | 482/145 |
| 5,722,919 | * | 3/1998 | Timmer | 482/105 |
| 5,971,902 | * | 10/1999 | Robertson et al. | 482/145 |

FOREIGN PATENT DOCUMENTS

1288074 * 2/1962 (FR) .

OTHER PUBLICATIONS

New York Barbells catalog (Undated).*

Commercial Equipment catalog (Undated).*

DE–STA–CLAMP catalog (Undated).*

* cited by examiner

*Primary Examiner*—John Mulcahy
(74) *Attorney, Agent, or Firm*—Thomas R. Shaffer, Esq.

(57) ABSTRACT

An exercise device is disclosed for exercising hamstring muscles, adductor/abductor muscles, quadriceps or gluteus maximus muscles of a user. The device includes a base member having a generally flat upper surface portion adapted to receive and support a bottom of a foot of the user. A back member is attached to the base. A heel yoke is attached to the back and is adapted to receive the heel of a foot of the user. A roller arm mechanism is attached to the back and a roller member is attached to the roller arm. The roller member is adapted to contact a top of the foot of the user to secure the device to the foot. Weight plates may be easily attached to and removed from the device to provide a desired resistance for a particular exercise.

17 Claims, 5 Drawing Sheets

EXERCISE DEVICE

BACKGROUND OF THE INVENTION

1. Field of the Invention

The present invention relates to exercise device. More particularly, it relates to a form of free weights which attach to the foot of a user for the exercise of at least one of the hamstring muscles, adductor/abductor muscles, quadriceps and gluteus maximus muscles of the user.

2. Prior Art

A variety of exercise devices have been proposed and are in use today for the exercise of virtually every muscle of the human body. With respect to exercise machines and devices which are used to strengthen and tone the hamstring muscles, adductor/abductor muscles, quadriceps and gluteus maximus muscles, there are currently limited options.

Perhaps the most effective existing device is the provision of weight belts which are secured around the ankle of the user by Velcro or other fastening means. There are several drawbacks with such ankle belts. First, the weights are positioned at a location up the leg toward the knee and away from the foot. This causes a diminution in the effectiveness of the weight and provides less resistance than weight positioned closer to the foot. Second, because of the shape of the weight belt and because it wraps around the ankle it is difficult to provide such a weight belt that allows the rapid adding or removal of weight elements to the device. Finally, the provision of heavy weights wrapped around one's ankle can be uncomfortable and annoying to the user.

Another known method of exercising hamstring muscles is accomplished with the use of standard free weight dumbbells. With this method the use lies flat on his or her stomach and a spotter places a dumbbell vertically positioned between users feet resting on soles. The user lift's his or her feet upwardly to a 90 degree position bending at the knees. This method has a number of significant drawbacks. First, the method requires the use of a spotter. Second, because the user is lying down, the resistance is greatest during the beginning of the motion with little resistance being offered as the lower leg approaches the upward 90 degree position. Finally, having dumbbell type weights held between feet can be unmanageable, hard to control and can expose user to injury should dumbbell slip from feet in uppermost position.

In addition to the above methods, there are a number of large, expensive exercise machines generally known as leg curl or leg extension machines which provide resistance training for these muscles groups. These machines are bulky, expensive and generally limit the range of possible motion to a single plane or a limited number of movement pathways.

There remains a need for a portable, inexpensive exercise device which addresses the limitations of the devices described above.

Accordingly, it is an object of the present invention to provide an inexpensive and portable exercise device which is useful in the exercise of at least one of the hamstring muscles, adductor/abductor muscles, quadriceps and gluteus maximus muscles of the user.

It is an object of the invention to provide such a device which quickly and efficiently attaches to the foot of the user.

It is an object of the invention to provide such a device which does not limit the user's range of motion thereby allowing flexibility in use and movement through any desired pathway, be it simple or complex, in any one or more of three planes of motion (or dimensions of space x, y and z).

It is an object of the invention to provide such a device which allows for the rapid addition or removal of weight plates to provide greater or less resistance when desired by the user.

These an other objects of the invention will be apparent from the further description of the invention which follows.

SUMMARY OF THE INVENTION

The present invention provides an exercise device for exercising at least one of the hamstring muscles, adductor/abductor muscles, quadriceps and gluteus maximus muscles of a user. The invention, in its simplest form, comprises a base member having a front portion and a back portion and including a generally flat upper surface portion adapted to receive and support a bottom of a foot of the user; a back member attached to said base; a heel yoke attached to said back and adapted to receive a heel of said foot of the user; roller arm means including an attached roller member attached to the back portion of said base, said roller member adapted to contact a top of said foot of the user whereby the exercise device is secured to said foot of the user.

In one form of the invention, the base member and said back member are integrally formed as a single member. Preferably, the upper surface of said base member is a slip resistant surface formed of aluminum with raised diamond shaped deformations therein.

In one form of the invention, the base member has rubber feet or other form of rubber covering at least a portion of a lower surface thereof. This allows the user to walk upon the devise when it is attached to the user's foot without damaging the flooring upon which the user walks.

The roller arm means is preferably pivotally mounted at one end thereof to said back portion of the base. A pivot lock means may be provided but is not presently preferred.

As an alternative to having the roller arm means pivotally mounted, the roller arm means may be rigidly mounted to said back member. Preferably, the roller arm means further comprises at least one member on which said roller member is slidably mounted whereby said roller arm means can be moved to any one of plurality of locations at differing distances from said back member. A length lock means may be provided whereby said roller is tightened onto the foot of a user and locked into one of said plurality of locations on said rod members.

The roller member of the present invention is preferably generally cylindrical in shape and formed of a foam material. In the preferred embodiment of the invention, the roller arm means further comprises a roller attachment bar to which a roller member is rotatably attached.

Preferably, the exercise device also includes weight plate holder means attached to said back member. The weight plate holder means preferably comprises at least one weight plate holder rod extending rearwardly from said back member. Preferably, the weight plate holder means is movably attached to the back member whereby said weight plate holder means can secured at any one of a plurality of transverse locations on said back member. A weight plate holder lock means is preferably used to secure said holder in a desired position. Additionally, weight plate lock means is provided to secure weight plates to the weight plate holder means. Preferably, the weight plate holder means is capable of receiving and holding a least one weight plate.

The exercise device of the present invention is adapted to be securely fastened to said foot of a user and said device may be freely moved by the user without restriction from any desired starting location to any desired finishing location through any desired pathway of movement wherein said pathway may include complex multiple plane movements.

DETAILED DESCRIPTION OF THE PREFERRED EMBODIMENTS

Figure 1:
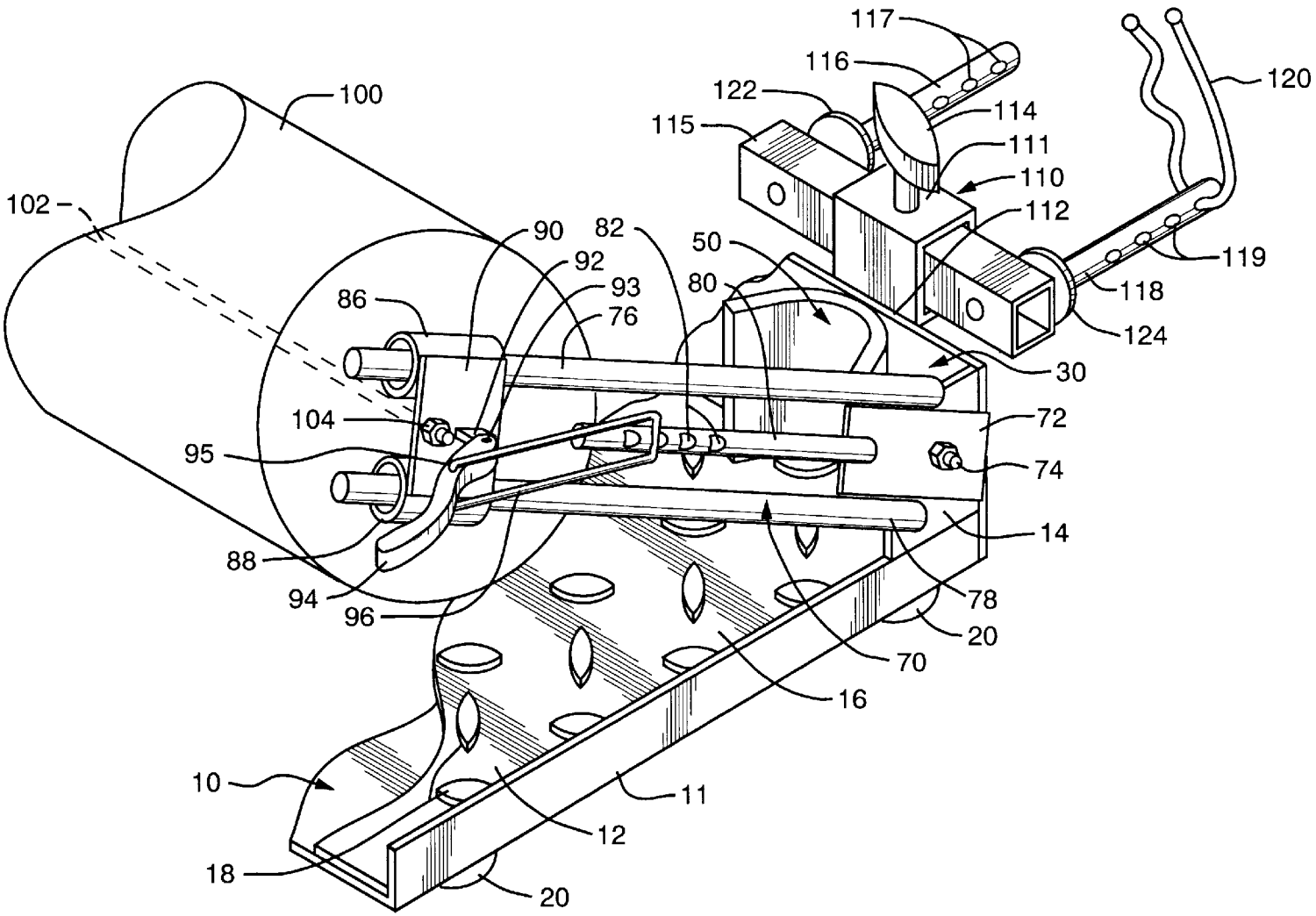
FIG. 1 is an isometric view of a portion of the exercise device of the present invention.

Referring to FIG. 1, the exercise device of the present invention includes a base member 10 which preferably includes a side portion 11. The base member has a front portion 12 and a back portion 14. Preferably, an upper surface portion 16 is formed of a non-slip surface. In the preferred embodiment, a thin sheet of aluminum having diamond shaped deformations 18 which rise upwardly from the upper surface 16 is utilized as the non-slip surface. Also in the preferred embodiment, rubber feet 20 are provided at each of the four corners of the base member 10 or a sheet of rubber is provided over the entire bottom surface.

A back member 30 is attached to the back portion 14 of the base member 10 or, if desired, the back member 30 may be integrally formed with base 10. A heel yoke 50 is attached to the back member 30.

A roller arm means 70 is pivotally attached to the back portion 14 of the base 10. The roller arm means in the preferred embodiment of the invention includes a plate 72 pivotally mounted to the back portion 14 of the base 10 by means of bolt and nut 74. A pair of rod members 76 and 78 are welded or otherwise attached to the plate member 72. A third rod member 80 is also attached to plate 72 and is provided with a plurality of slots 82 which are a part of the length lock means of the present invention. Tube members 86 and 88 which are connected together by plate number 90 are adapted to slide forwardly and rearwardly on rod members 76 and 78, respectively. A handle 94 is pivotally mounted on an ear 92 at pivot 93 on the plate member 90. A U-shaped member 96 is pivotally attached at pivot point 95. A forward end of the U-shaped member 96 is adapted to be received by one of the slots 82. It will be obvious to those skilled in the art that by moving the handle 94 rearwardly, the roller 100 will be moved closer to the heel yoke 50 member and locked into a secure position.

The roller 100 is attached to the device by means of a rod 102 which extends through the center of the roller 100 and is secured by bolt 104. Although not shown, the opposite side of the roller arm means has identical components which in some of the other drawings are shown with prime numbers.

The device also includes a weight holder means 110. The weight holder means includes a stationary tube member 111 which is welded to back 30 at the location 112. A screw knob 114 is provided on the top of tube member 111. Tube member 115 is adapted to slide transversely within tube member 111 but is secured in a stationary position by twisting the screw knob 114. Tube 115 has weight holding rod members 116 and 118 extending rearwardly therefrom. Rod 116 is provided with a plurality of holes 117 and similarly rod member 118 is provided with a plurality of holes 119. These rod members 117 and 118 are adapted to receive, if desired, one or more weight plate members as is shown in all of the remaining figures. The weight plate members 130 are secured in place by means of cotter pins 120.

Preferably, the roller arm means 70 freely pivots around pivot point 74. However, if desired, it will be obvious that, for example, by tightening the nut 74, the roller arm means 70 may be fixed in a rigid position. It is preferred, however, to allow roller arm means 70 to pivot freely.

Figure 2:
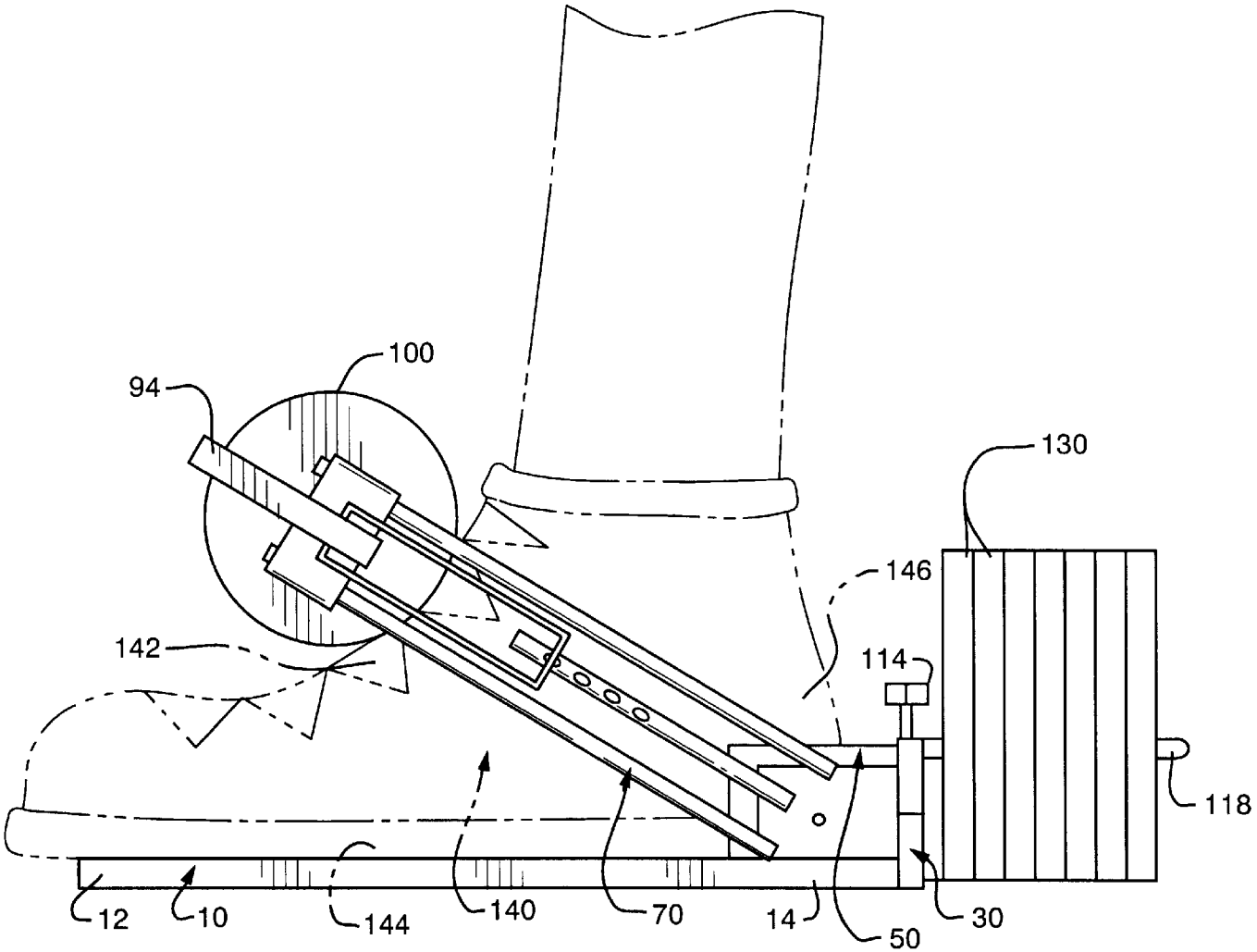
FIG. 2 is a side view of the exercise device of the present invention as removable attached to the foot of a user.

Referring specifically to FIG. 2, the exercise devise of the present invention is shown as attached to the foot 140 of a user. As shown, the foam roller member 100 is pressed against the top of the foot 142 by tightening the handle 96. This forces the heel of the foot 146 to be engaged in the heel yoke member 50. As shown, a number of weight plates 130 are attached to the device.

Figure 3:
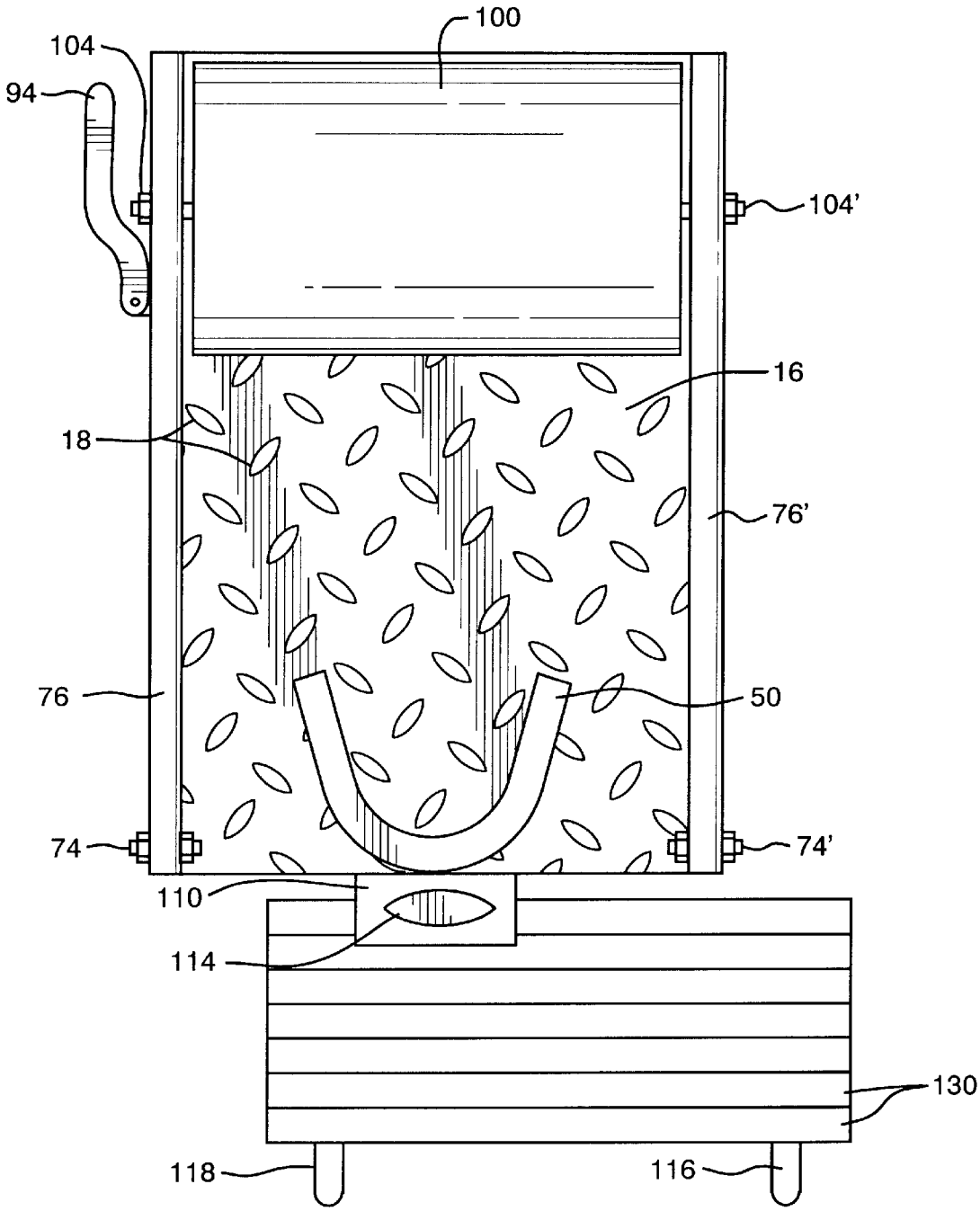
FIG. 3 is top view of the exercise device of the present invention showing weight plates shifted to the right.

FIG. 3 shows the weight plates shifted to the right with the screw knob 114 holding them in the desired shifted position.

Figure 4:
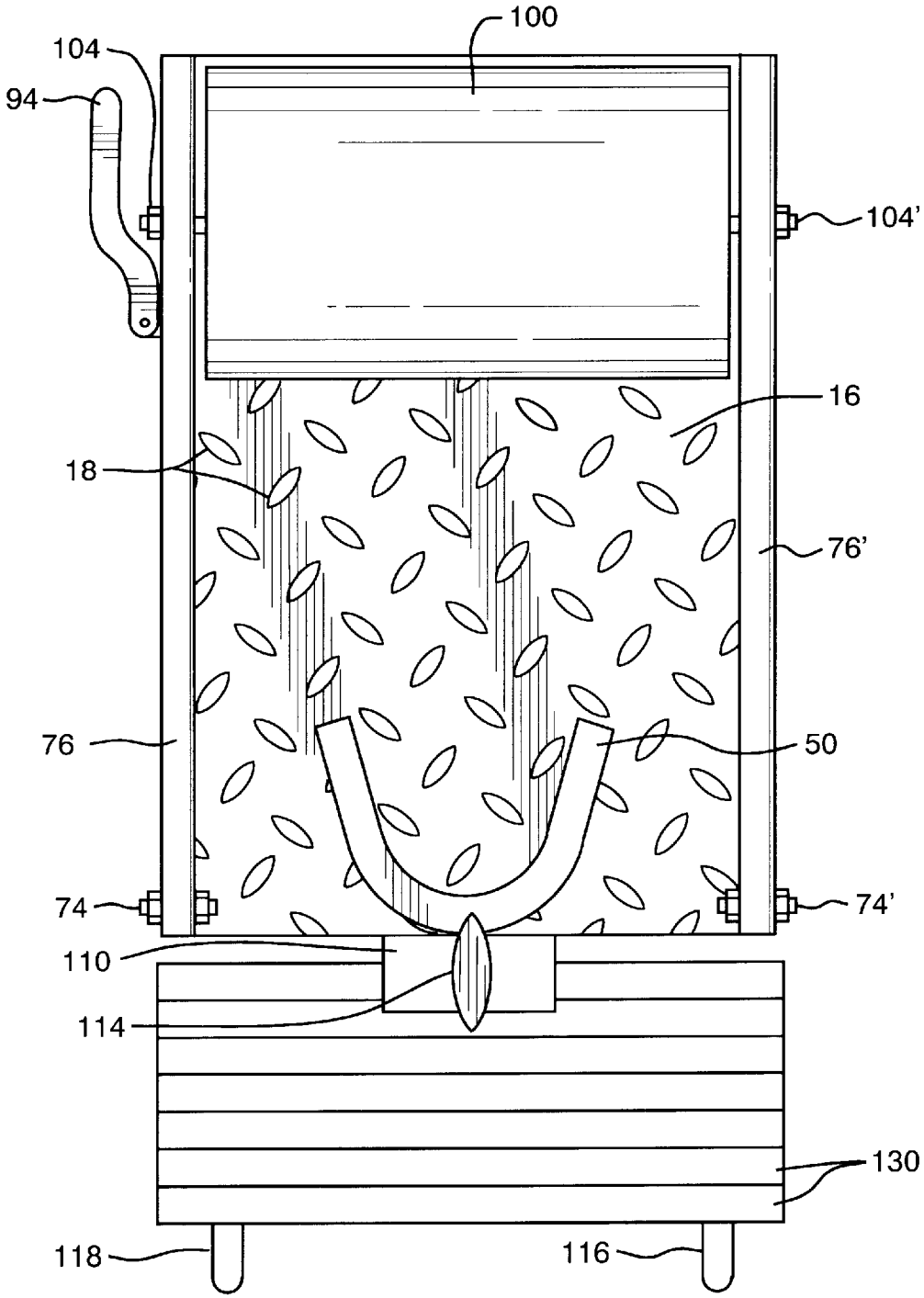
FIG. 4 is top view of the exercise device of the present invention showing weight plates in a central position.

FIG. 4 is a similar view which shows the weight plates 130 in the normal central position.

Figure 5:
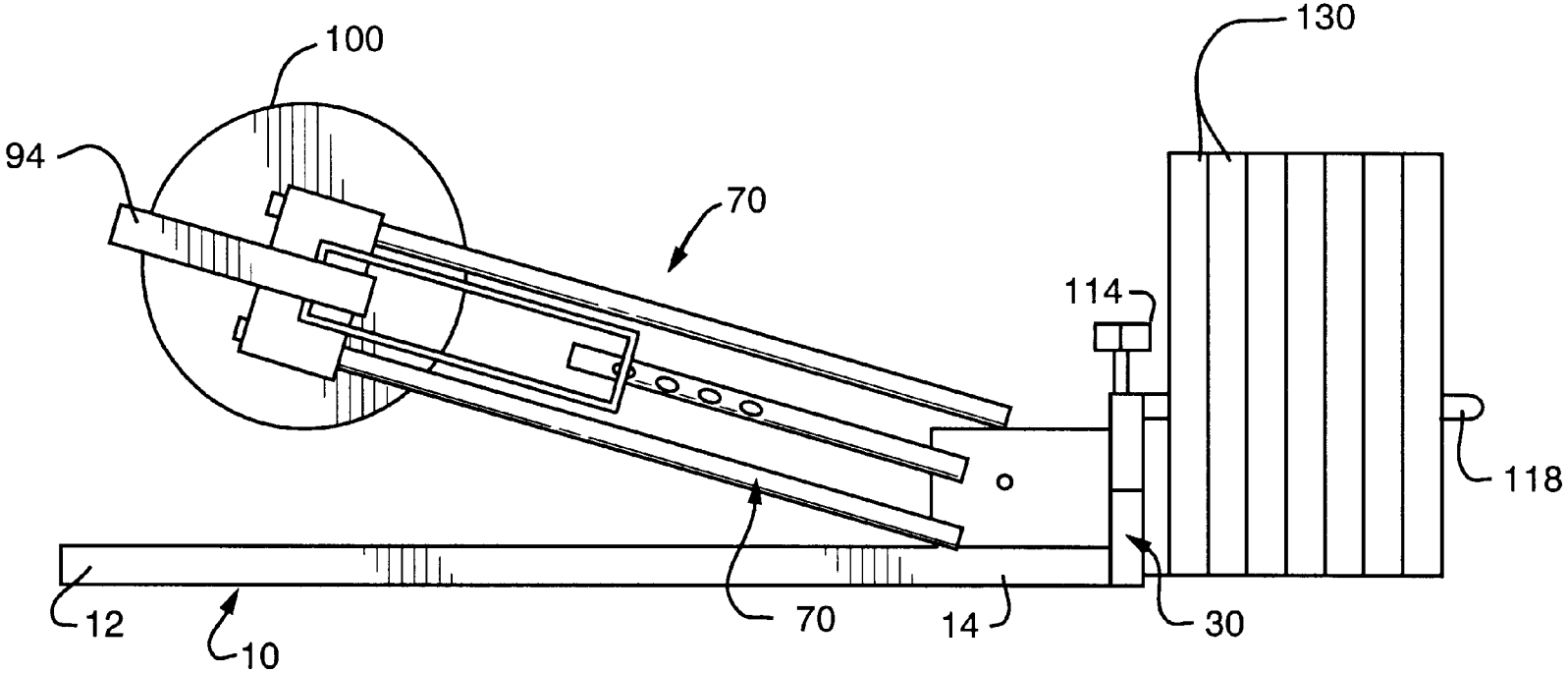
FIG. 5 is a side view of the exercise device of the present invention with attached weight plates.

Finally, FIG. 5 is a side elevational view showing the device of the present invention with a number of weight plates 130 secured.

In use, the user places his heel 146 into the heel yoke member 50, slides the tube members 86 and 88 inwardly towards the heel member 50 on rod members 76 and 78 respectively until the roller is positioned to contact the top portion 142 of the users foot 140. Then, the user places the U-shaped portion 96 of the length lock means into a desired slot 82 in rod 80. Thereafter, by moving the handle 94 forwardly, the roller is pushed tightly against the top of the foot 142 and locked into an appropriate position. Any number of weight plate 30 may thereafter (or previously) be placed on the weight bearing rods 116 and 118 and secured by cotter pins 120.

The most common exercise for use with the device entails the user standing perfectly erect and straight. The user then lifts his heel rearwardly and upwardly towards the user's back in a slow and deliberate motion. The user then holds his foot and the device with his knee bent in a 90° angle for a desired period of time and then returns to the straight upright position. It will be obvious to those skilled in the art that because the device is only attached to the foot, it is not guided by any other mechanism, that the device may be freely moved by the user without restriction from any desired starting location to any desired finishing location through any desired pathway of movement even wherein said pathway may include complex multiple plain movements. Thus, a variety of exercises may be performed with the device as will be obvious to those skilled in the art.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An exercise device for exercising at least one of the hamstring muscles, adductor/abductor muscles, quadriceps and gluteus maximus muscles of a user comprising:

a) a base member having a front portion and a back portion and including a generally flat upper surface portion adapted to receive and support a bottom of a foot of the user;

b) a back member attached to said back portion of said base;

c) a heel yoke attached to said back member and adapted to receive the heel of said foot of the user;

d) roller arm means attached to said back portion of said base including a roller member adapted to contact a top of said foot of the user whereby the exercise device is removably secured to said foot of the users;

e) weight plate holder means attached to said back member, said weight plate holder means being movably attached to the back member whereby said weight plate holder means can secured at any one of a plurality of transverse locations on said back member; and f) weight plate holder lock means to secure said weight plate holder means in a desired position.

2. An exercise device according to claim 1 wherein said base member and said back member are integrally formed as a single member.

3. An exercise device according to claim 1 wherein said upper surface of said base member is a slip resistant surface.

4. An exercise device according to claim 3 wherein said upper surface is formed of aluminum with raised deformations therein.

5. An exercise device according to claim 1 wherein said base member has rubber covering at least a portion of a lower surface thereof.

6. An exercise device according to claim 1 wherein said roller arm means is pivotally mounted at one end thereof to said back portion of said base.

7. An exercise device according to claim 6 further comprising a pivot lock means to hold said arm in a selected one of a plurality of pivotal positions.

8. An exercise device according to claim 1 wherein said roller arm means is rigidly mounted to said back member.

9. An exercise device according to claim 1 wherein said roller arm means further comprises at least one rod member on which said roller member is slidably mounted whereby said roller member can be moved to any one of plurality of locations at differing distances from said back member.

10. An exercise device according to claim 9 further comprising a length lock means whereby said roller is tightened onto the foot of a user and locked into one of said plurality of locations on said rod member.

11. An exercise device according to claim 1 wherein said roller member is generally cylindrical in shape.

12. An exercise device according to claim 1 wherein said roller member is formed of a foam material.

13. An exercise device according to claim 1 wherein said roller arm means further comprises a roller attachment rod on to which a roller member is rotatably attached.

14. An exercise device according to claim 1 wherein weight plate holder means comprises at least one weight plate holder rod extending rearwardly from said back member.

15. An exercise device according to claim 1 further comprising weight plate lock means.

16. An exercise device according to claim 1 wherein said weight plate holder means is capable of receiving and securing a least one weight plate.

17. An exercise device according to claim 1 wherein said exercise device is adapted to be securely fastened to said foot of a user and wherein said device may be freely moved by the user without restriction from any desired starting location to any desired finishing location through any desired pathway of movement wherein said pathway may include complex multiple plane movements.

* * * * *